US007934854B2

(12) United States Patent
Anglikowski et al.

(10) Patent No.: US 7,934,854 B2
(45) Date of Patent: May 3, 2011

(54) LIGHT FIXTURE WITH OPTIONAL ANIMATE OBJECT DETECTOR AND HEAT SINK

(75) Inventors: Ronald Edward Anglikowski, Bowling Green, KY (US); David Scott Bullard, Bowling Green, KY (US); William Calvin Raper, Sparta, TN (US); Jeremy Lee Prichard, Cave City, KY (US)

(73) Assignee: HeathCo LLC, Bowling Green, KY (US)

( * ) Notice: Subject to any disclaimer, the term of this patent is extended or adjusted under 35 U.S.C. 154(b) by 147 days.

(21) Appl. No.: 12/059,373

(22) Filed: Mar. 31, 2008

(65) Prior Publication Data

US 2009/0244897 A1 Oct. 1, 2009

(51) Int. Cl.
*F21V 21/26* (2006.01)

(52) U.S. Cl. ..... 362/269; 362/276; 362/285; 362/294

(58) Field of Classification Search ..... 362/269, 362/276, 285, 294
See application file for complete search history.

(56) References Cited

U.S. PATENT DOCUMENTS

| | | | | |
|---|---|---|---|---|
| 3,749,903 | A | | 7/1973 | Belokin, Jr. |
| 4,717,910 | A | | 1/1988 | Scripps et al. |
| 4,757,204 | A | | 7/1988 | Baldwin et al. |
| 4,823,051 | A | | 4/1989 | Young |
| 5,050,047 | A | | 9/1991 | Viner et al. |
| 5,590,953 | A | | 1/1997 | Haslam et al. |
| 5,649,761 | A | * | 7/1997 | Sandell et al. ..... 362/276 |
| 5,662,411 | A | | 9/1997 | Haslam et al. |
| 5,857,769 | A | | 1/1999 | Beggs |
| 5,941,630 | A | | 8/1999 | Finke et al. |
| 6,151,529 | A | | 11/2000 | Batko |
| 6,168,282 | B1 | | 1/2001 | Chien |
| D453,387 | S | | 2/2002 | Leen |
| 6,348,691 | B1 | | 2/2002 | Sandell et al. |
| 6,781,129 | B2 | | 8/2004 | Leen |

(Continued)

FOREIGN PATENT DOCUMENTS

| | | |
|---|---|---|
| CA | 2 277 645 A1 | 1/2001 |
| JP | 10188660 A | 7/1998 |

OTHER PUBLICATIONS

Smarthome Webpage—http://www.smarthome.com/4650B.html.

*Primary Examiner* — Sandra L O Shea
*Assistant Examiner* — Meghan K Dunwiddie
(74) *Attorney, Agent, or Firm* — Fitch Even Tabin & Flannery

(57) ABSTRACT

A light fixture (100) comprises a base (101) and at least a first arm (102) having a first end (103) that couples to this base. A housing (105) then couples to the second end (203) of this first arm and can serve to house both a light source (901) (such that emanated light will tend to be directed towards a primary area of coverage) and an animate object detector (902) (such that the latter will be aimed towards, and will tend to be sensitive to, objects that move within the primary area of coverage). By one approach, this arm couples to the base and/or the housing in a manner that permits an end user to adjust a position of the housing with respect to the base without requiring any hand tools. The housing can comprise a heat sink (906) if desired.

20 Claims, 4 Drawing Sheets

U.S. PATENT DOCUMENTS

| | | | | |
|---|---|---|---|---|
| 6,940,230 | B2 | 9/2005 | Myron et al. | |
| 6,948,831 | B1 | 9/2005 | Naqvi | |
| 7,182,487 | B1 | 2/2007 | Pickard et al. | |
| 7,195,381 | B2 * | 3/2007 | Lynam et al. | 362/494 |
| 7,339,471 | B1 | 3/2008 | Chan et al. | |
| 2003/0117803 | A1 | 6/2003 | Chen | |
| 2003/0123252 | A1 | 7/2003 | Cercone et al. | |
| 2004/0057234 | A1 * | 3/2004 | Mohacsi | 362/231 |
| 2006/0092338 | A1 | 5/2006 | Sakai et al. | |
| 2007/0064427 | A1 * | 3/2007 | Sibalich et al. | 362/276 |

* cited by examiner

LIGHT FIXTURE WITH OPTIONAL ANIMATE OBJECT DETECTOR AND HEAT SINK

RELATED APPLICATION(S)

This application is related to co-pending and co-owned U.S. patent application Ser. No. 12/059,290, entitled A WALL-MOUNTABLE LIGHT FIXTURE PROVIDING LIGHT HAVING A PARTICULAR DIRECTIONALITY and filed on even date herewith, which is incorporated by reference in its entirety herein.

TECHNICAL FIELD

This invention relates generally to light fixtures and more particularly to light fixtures having an animate object detector.

BACKGROUND

Light fixtures of various kinds are known in the art. Such light fixtures serve a variety of intended purposes. In some cases, for example, a given light fixture is intended to serve a security purpose. In such a case, the illumination from the light fixture is typically designed to increase the visibility of unauthorized persons to either dissuade or discourage their continued proximity and/or to make it easier for others to observe the unauthorized persons and take appropriate corresponding action. In other cases, and again by way of example, a given light fixture is intended to serve a convenience and/or safety function. In such a case, the illumination from the light fixture is typically designed to illuminate a pathway or an obstacle that might otherwise be difficult to navigate or avoid in the dark.

Many light fixtures are relatively non-adjustable or permit only some modicum of course adjustability at the time of installation. Non-adjustable light fixtures, however, are not well suited to all application settings. In many specific cases, for example, the light from a given non-adjustable light fixture will be inappropriately or insufficiently directed in order to achieve the desired security and/or convenience/safety purpose.

Accordingly, adjustable light fixtures are also known in the art. In many such cases the adjustable light fixture comprises a base element that can be attached to a mounting surface and which supports one or more somewhat adjustable lighting elements (such as a socket that can receive a spotlight bulb). Though adequate for many application settings, again, many existing designs in these regards do not fully address the needs of some installation scenarios as many such designs permit only limited adjustability. Furthermore, in many cases the adjustability of such fixtures is achieved by manipulation of clumsy and inconvenient threaded members. These mechanisms can be quite challenging in use and often result in adjusted orientations that are not precisely what the installer intends.

Other challenges can be noted as well. As one example in this regard, some lighting fixtures can experience considerably elevated local temperatures due to waste heat from the lighting source(s) being employed. This, in turn, has the potential in some cases to negatively impact the operational lifetime of the lighting source (when, for example, the lighting source comprises one or more light emitting diodes) and/or can impact the performance of an animate object detector that may comprise a part of the light fixture.

BRIEF DESCRIPTION OF THE DRAWINGS

The above needs are at least partially met through provision of the light fixture with optional animate object detector and heat sink described in the following detailed description, particularly when studied in conjunction with the drawings, wherein.

Figure 1:
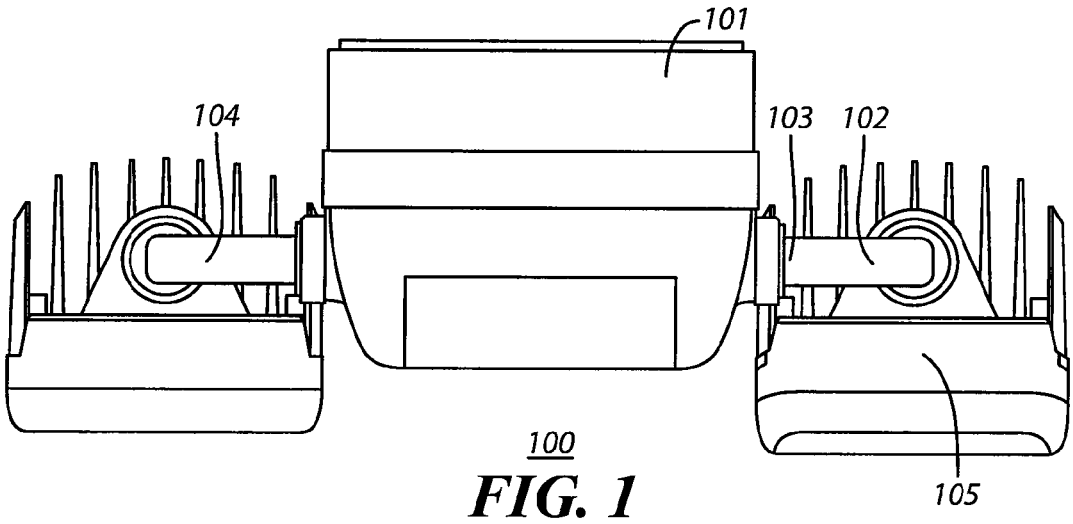
FIG. 1 comprises a top plan view as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to at least certain of these various embodiments, a light fixture can comprise a base that is configured and arranged to mount to a support surface in an installed position and at least a first arm having a first end that couples to this base. A housing can then be coupled to the second end of this first arm (such that the housing is disposed outwardly of the base) and can serve to house both a light source (such that light from the light source will tend to be directed towards a primary area of coverage) and an animate object detector (such that the animate object detector will move in tandem with the light source as the housing is moved and such that the animate object detector will be aimed towards, and will tend to be sensitive to, animate objects that move within the primary area of coverage). By one approach, this arm couples to the base and/or the housing in a manner that permits an end user to adjust a position of the housing with respect to the base without requiring any tools.

By one approach, this housing can further comprise a thermal barrier that is disposed between the light source and the animate object detector to thereby substantially prevent the light source from interfering with operability of the animate object detector. These teachings will also accommodate providing the housing with an externally exposed heat sink that is configured and arranged to sink heat sourced by the light source. This heat sink can comprise, at least in part, a plurality of heat radiating fins. Also if desired, these heat radiating fins can have, in combination with one another, a peripheral envelope that is contoured to thereby prevent the heat radiating fins from obstructing movement of the housing with respect to the base.

Those skilled in the art will recognize and appreciate that numerous benefits are available via such teachings. The hand-based adjustability permits the housing, and hence the light source, to be directable in virtually any direction thereby permitting maximum flexibility with respect to installation and with respect to meeting the lighting needs of unique application settings. Incorporation of an animate object detector with the lighting source in the housing, of course, permits such a light fixture to provide lighting that remains effective with respect to sensed movement notwithstanding the adjustability described above.

These and other benefits may become clearer upon making a thorough review and study of the following detailed description. Referring now to the drawings, and in particular to FIG. 1, various illustrative examples that accord with these teachings will be provided.

FIG. 1 comprises a top plan view of a light fixture 100 that comprises a base 101 which can be attached in an installed position on, for example, a support surface (not shown) of choice. The support surface can comprise an interior or exterior surface. These teachings will accommodate support surfaces having a variety of orientations including, but not limited to, vertical surfaces (such as walls) and horizontal surfaces (such as ceilings, eaves, and so forth). This base 101 can be comprised of any suitable material including, but not limited to, a variety of metals, plastics, and the like.

There are various ways by which such a base 101 can be attached to a support surface as will be well understood by those skilled in the art. This can include the use of any of a wide variety of adhesives as well as various attachment members such as impalement members (such as nails and spikes), threaded members (such as screws and bolts), clips, magnets, and so forth. As these teachings are not overly sensitive to any particular selection in this regard, for the sake of brevity and the preservation of clarity, further elaboration in this regard will not be presented here.

By one approach, this base 101 can contain active electronics such as control circuitry for automatically controlling the operation of the light sources described further below. By another approach, this base 101 can essentially serve to house the electrical connections between the light fixture's components and the mains electricity (with any active electronics being disposed elsewhere in the light fixture 100). It would also be possible for this base 101 to house, for example, an animate object detector, an ambient light sensor, or any other component which may be useful with respect to the needs and/or opportunities as tend to characterize a given application setting.

Figure 2:
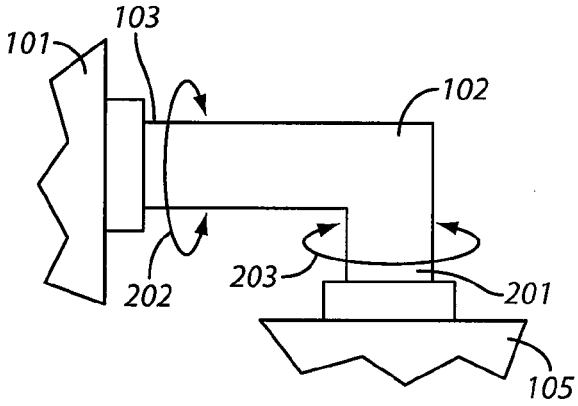
FIG. 2 comprises a side elevational schematic detail view as configured in accordance with various embodiments of the invention.

This light fixture 100 also comprises a first arm 102 having a first end 103 that is coupled to the base 101. This light fixture 100 can have additional such arms such as the second arm 104 shown coupled on an opposing side of the base 101. As such additional arms can be identical to the first arm 102 aside from their orientation, for the sake of brevity and simplicity this description will largely focus on the first arm 102. Referring momentarily to FIG. 2 (which provides a front elevational view of the first arm 102), by one approach this first arm 102 can comprise an L-shaped component. Referring now to both FIGS. 1 and 2, the corresponding second end 201 of this first arm 102 can couple to a housing 105 such that the housing 105 is disposed outwardly of the base 101. In particular, and as is clearly illustrated in FIG. 1, this housing 105 is disposed sufficiently distal to the base 101 such that there is no point of contact between the two that might inhibit movement of the housing 105 as described herein.

This first arm 102 can be comprised of any material of choice including an appropriate metal or plastic material. Generally speaking, the material (and/or its protective coating, where applicable) should be weather resistant and should also be sufficiently strong to withstand the service and manipulations described herein. The first arm 102 can be partially or wholly hollow as desired. When hollow, this arm can accommodate electrical conductors to convey, for example, electricity from the base 101 to the housing 105 as desired.

By one approach, this first arm 102 couples to the base 101 and/or to the housing 105 in a manner that permits an end user to adjust a position of the housing 105 with respect to the base 101 with respect to at least a first dimension of adjustability. By one approach, this can comprise bare hand-based manipulations that are made without requiring any hand tools (such as wrenches, pliers, screwdrivers, or the like). With continued reference to FIG. 2, for example, this can comprise coupling the first arm 102 to the base 101 in a manner that permits rotation of the first arm 102 in a first dimension about the axis as corresponds to the first end 103 of the first arm 102 as denoted by reference numeral 202. This can also comprise coupling the first arm 102 to the housing 105 in a manner that permits rotation of the second end 201 of the first arm 102 with respect to the housing 105 in a second dimension about the axis as corresponds to the second end 201 of the first arm 102 as denoted by reference numeral 203.

Figure 3:
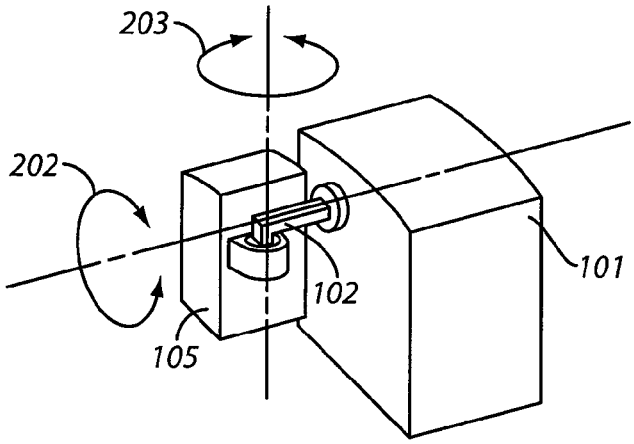
FIG. 3 comprises a perspective schematic view as configured in accordance with various embodiments of the invention.

As illustrated in this example this second dimension of adjustability can be different from the first dimension of adjustability. In this particular illustrative example, the second dimension of adjustability is substantially perpendicular to the first dimension of adjustability. So configured, and referring now momentarily to FIG. 3, it will be readily appreciated that the housing 105 can be effectively adjusted to have its front surface oriented in virtually any direction of choice. This is owing both to the perpendicularly-oriented dimensions of adjustability and also to the provision of sufficient clearance between the housing 105 and the base 101 such that the base will not constitute an obstruction to such adjustments.

Figure 4:
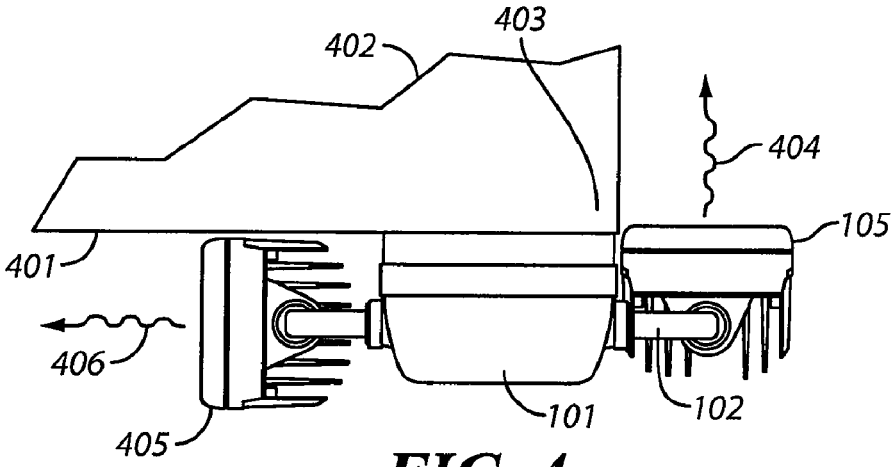
FIG. 4 comprises a top plan schematic detail as configured in accordance with various embodiments of the invention.

As one illustrative example in this regard, and referring now momentarily to FIG. 4, the base 101 is shown mounted on the wall 401 of a building 402 near a corner 403 thereof.

Because of the great degree of freedom with respect to the adjustment of the housing 105, it is possible to orient the housing 105 to be directed in a way that permits the housing 105 to face a direction that is literally around this corner 403 (including, as illustrated, in a direction that is essentially parallel to that first wall). This, in turn, will permit a light source that is disposed within this housing 105 to shine a light 404 in that same direction. At the same time, a second housing 405 on an opposing side of the base 101 having similar adjustability can be readily oriented to aim its light 406 in a completely different direction if desired (including, as illustrated, in a direction that is essentially parallel to a second wall that is perpendicular to the first wall, such that the resultant light from these two housings 105 and 405 is separated by approximately 270 degrees).

Figure 5:
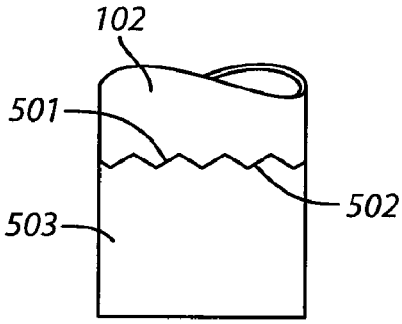
FIG. 5 comprises a side elevational detail view as configured in accordance with various embodiments of the invention.
Figure 6:
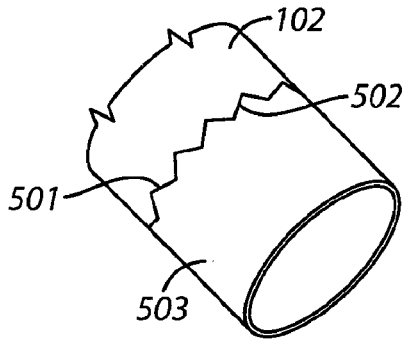
FIG. 6 comprises a perspective detail view as configured in accordance with various embodiments of the invention.

As noted earlier, by one approach, the adjustment of the orientation of the housing 105 can be achieved by bare handed manipulation of the housing 105 if desired. There are various ways by which this can be achieved. Referring now to FIGS. 5 and 6, one illustrative example in this regard will be described. Those skilled in the art will recognize and understand that this example is intended to serve only in an illustrative capacity and is not intended to comprise an exhaustive listing of all possibilities in this regard.

In this illustrative example the ends of the first arm 102 comprise an engagement surface 501 which comprises a series of triangularly-shaped teeth. This engagement surface 501 is configured and arranged to engage a corresponding engagement surface 502 on an opposing member 503 that is attached, for example, to the base 101 and/or the housing 105. In this illustrative embodiment this corresponding engagement surface 502 is substantially identical to the engagement surface 501 such that the teeth are able to essentially nest with one another without substantial gaps or the like. By then biasing these engagement surfaces towards one another using one or more biasing mechanisms of choice (not shown), these respective components will tend to remain in a given position.

Figure 7:
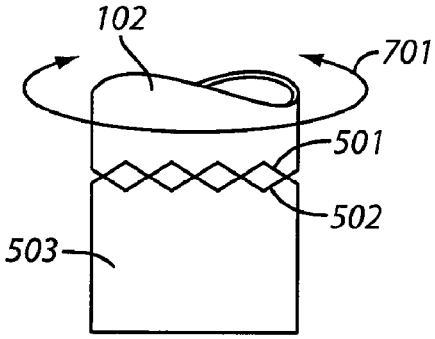
FIG. 7 comprises a side elevational detail view as configured in accordance with various embodiments of the invention.

Referring now to FIG. 7, by applying a sufficient rotational force 701, these engagement surfaces 501 and 502 can be rotated with respect to one another. As the teeth move with respect to one another, they will move in a ratchet-like manner. As a result, and presuming that the rotational force 701 required to overcome the aforementioned biasing is within an average adult human's ordinary level of strength, the arm 102 and/or the housing 105 can be rotated with respect to one other on a tooth-by-tooth basis. This, in turn, permits relatively fine adjustments to be made with respect to the desired orientation of the housing 105 with respect to the base 101.

By selecting the biasing force to be such that these components will tend to stay in their selected position once the rotational force 701 is released, and by further selecting the biasing force such that overcoming this rotational force 701 is within the power and capabilities of the average person's hand-based strength, it will be appreciated these teachings provide for an effective, quick, convenient, and hand tool-free approach to permitting desired adjustments of the housing 105 with respect to the base 101.

Figure 8:
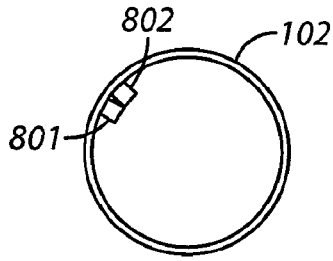
FIG. 8 comprises a top plan detail view as configured in accordance with various embodiments of the invention.

By one approach, such rotations may be accommodated with limit. This, however, may permit these components to be rotated until, for example, an electrical conductor that is carried within the first arm 102 to be twisted to the point of breaking. To prevent this from occurring, one or more stops can be employed. To illustrate by way of one example in this regard, and referring now to FIG. 8, a first stop 801 which is attached to the interior of the first arm 102 can be positioned to contact a second stop 802 that is attached to the interior of the opposing component 503. When these two stops 801 and 802 contact one another, further rotation will be blocked. Other possibilities of course exist in this regard as will be evident to those skilled in the art.

Figure 9:
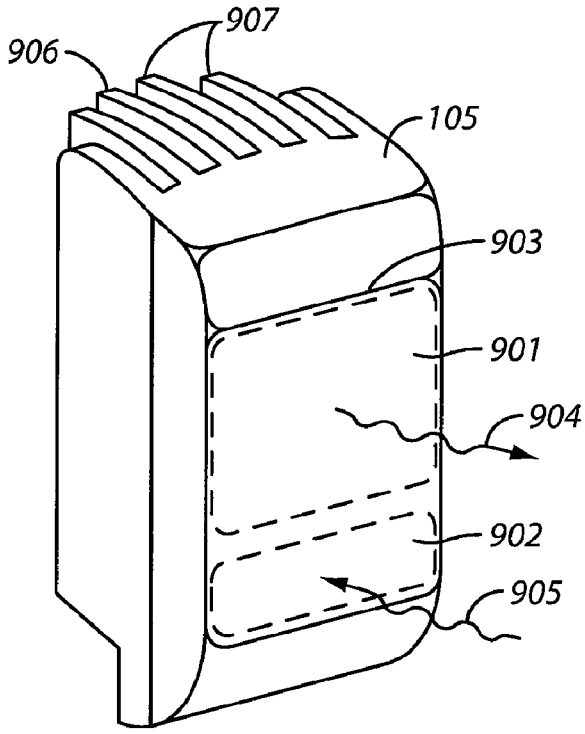
FIG. 9 comprises a perspective view as configured in accordance with various embodiments of the invention.

Referring now to FIG. 9, this housing 105 can serve, at least in part, to house both a light source 901 and an animate object detector 902. Various light sources are known in the art can be applied as desired. In this illustrative example, and without intending any particular limitations in this regard, the light source 901 will be presumed to comprise an array of permanently installed light emitting diodes. Such components, and their use for lighting purposes, comprise a well understood area of endeavor and require no further elaboration here. For most purposes it will probably be useful if these light emitting diodes provide a white (or a nearly white) light though other colors can be considered where the application setting might benefit in this regard.

As for the animate object detector 902, numerous possibilities exist in this regard as well. This animate object detector 902 might comprise, for example, a passive infrared (PIR)-based detector as are known in the art. Other examples include, but are not limited to, an image-based detector (which operates, for example, using digital photographic images which are processed to detect, via pattern comparisons, the presence of an animate object), a sound-based detector (which operates, for example, using ultrasonic reflections to detect the presence of an animate object), an active light-based detector (such as a laser-based detection system as are known in the art), and so forth.

In FIG. 9, these two components are shown in phantom lines because they are hidden (or at least are located) behind a protective lens 903. This lens 903 can be comprised, for example, of material that is transparent to both visible light 904 as emanates from the light source 901 and to whatever carrier 905 is employed by the animate object detector 902. Various plastics, for example, will suffice in this regard as will be well understood by those skilled in the art. It would be possible to dispense with this lens 903 but, at least for many application purposes, such a lens 903 can serve to protect these components from various environmental stresses.

Figure 10:
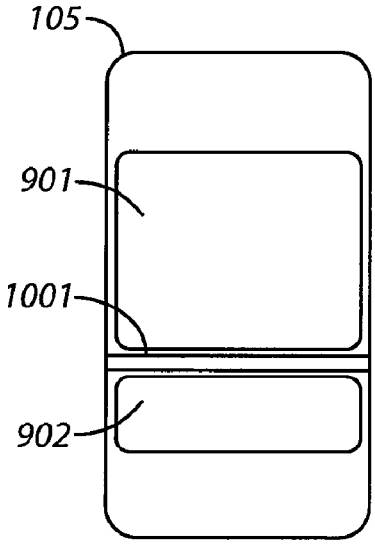
FIG. 10 comprises a front elevational schematic view as configured in accordance with various embodiments of the invention.
Figure 11:
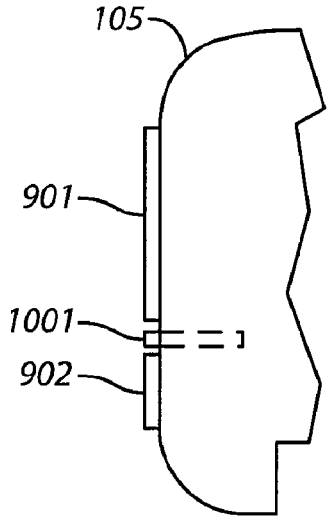
FIG. 11 comprises a side elevational schematic detail view as configured in accordance with various embodiments of the invention.

FIGS. 10 and 11 depict the light source 901 and the animate object detector 902 with this lens 903 having been removed. These views, in turn, provide an unobstructed view of a thermal barrier 1001 that has been disposed in this illustrative embodiment between the light source 901 and the animate object detector 902. By one approach, and as illustration by way of example and not by way of limitation in FIG. 11, this thermal barrier 1001 can extend inwardly of the housing 105 if desired. The purpose of this thermal barrier 1001 is to substantially prevent heat emanating from the light source 901 from interfering with operability of the animate object detector 902 (as might occur, for example, when the animate object detector 902 comprises a heat-sensitive component such as a PIR-based detector). This thermal barrier 1001 can accordingly be comprised of any of a variety of materials (or combinations of such materials) such as, but not limited to, phenolic resin products (such as, but not limited to, the AG-4 phenolic resin often identified as bakelite), an encapsulated chamber of air or other insulating gas, numerous ceramics, and various plastics which are known to have thermally isolating characteristics.

Those skilled in the art will understand that such a thermal barrier 1001 can facilitate the provision of a relatively compact housing 105 that contains both a heat source such as a light source and a heat-sensitive component such as certain animate object detectors without impairing the efficacy of the heat-sensitive component.

As another way of assisting in this regard, and/or to aid in otherwise dissipating heat that might otherwise be expected to negatively impair the operational lifetime of the light source itself (such as, for example, when the light source comprises an array of light emitting diodes), these teachings will accommodate also providing the housing 105 with one or more externally exposed heat sinks. As used herein, this reference to "externally exposed" will be understood to refer to a location that is external to the internal portions of the housing 105 and which is accordingly exposed to local environmental conditions. Accordingly, these teachings will permit protecting the heat sink from small insects, or animals (such as spiders or the like) by the use of a screen or the like while still remaining consistent with this notion of being externally exposed.

This heat sink can be comprised of any material having the desired thermal characteristics. In particular, the selected material should serve to readily sink heat from the light source 901 and to also readily release that heat to the local environment. Those skilled in the art will recognize that aluminum is one material that is known to be useful in this regard.

An example of such a heat sink 906 can be viewed in FIG. 9. In this illustrative example, the heat sink 906 comprises a plurality of heat radiating fins 907 that couple to the rear surface of the housing 105 and which extend rearwardly thereof. In this particular illustrative example the heat radiating fins 907 are vertically aligned with respect to the installed orientation of the base 101. If desired, it would be possible to use other alignment patterns.

Figure 12:
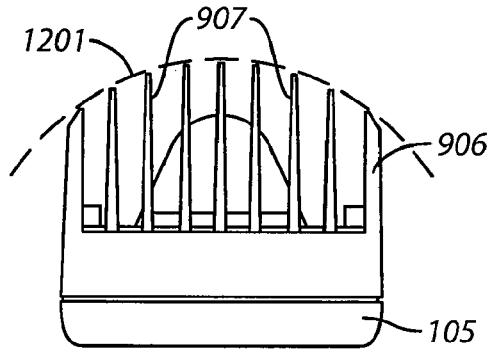
FIG. 12 comprises a bottom plan view as configured in accordance with various embodiments of the invention.
Figure 13:
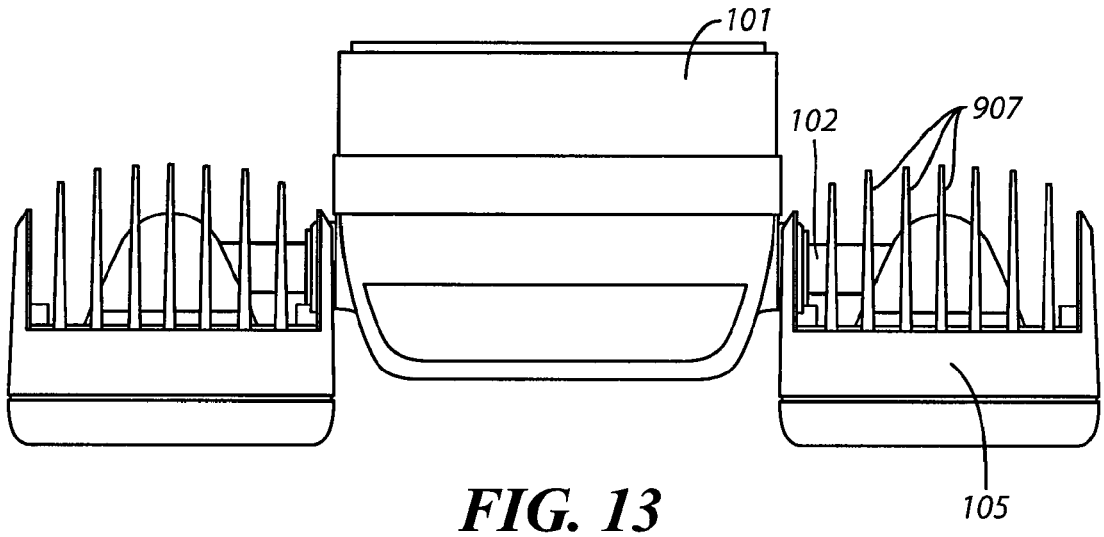
FIG. 13 comprises a bottom plan view as configured in accordance with various embodiments of the invention.

Referring now to FIG. 12, by one approach, this plurality of heat radiating fins 907 can have, in combination with one another, a peripheral envelope (as denoted by phantom line 1201) that is contoured to thereby prevent any of the heat radiating fins 907 from obstructing movement of the housing 105 with respect to the base 101. As is perhaps best appreciated with reference to the bottom plan view provided at FIG. 13, by contouring the heat radiating fins 907 in this regard, the housing 105 can be rotated with respect to the first arm 102 (and/or with respect to the base 101 itself by rotation of the first arm 102) without the possibility of any contact between the base 101 and any of the heat radiating fins 907.

Figure 14:
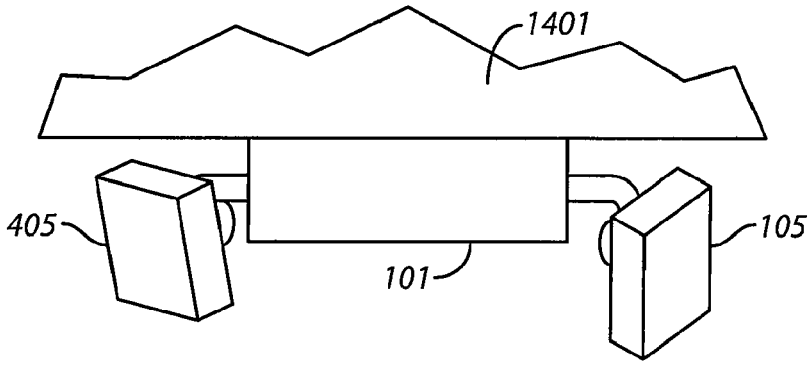
FIG. 14 comprises a front elevational view as configured in accordance with various embodiments of the invention.

Those skilled in the art will recognize and appreciate that these teachings provide a highly flexible and leverageable set of opportunities by which a wide variety of light fixtures can be usefully configured and deployed. For example, as illustrated in FIG. 14, such a light fixture can have its base 101 mounted to the underside of a building's eaves 1401 and serve in a wholly satisfactory manner as a direct result of this great flexibility with respect to adjusting and orienting the housings 105 and 405. These teachings are highly tolerant of a wide variety of light sources and animate object detectors. It will be appreciated that these teachings are also highly scalable and can be employed with as few, or as many, light source housings as may be appropriate to meet the needs of a given application setting. It will further be recognized that the ease and hand tool-free manner by which these teachings will permit the directionality of a given light source to be adjusted by even an unskilled and untrained installer comprises a significant benefit.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. A light fixture comprising:

a base configured and arranged to be mounted to a support surface in an installed position;

at least a first arm having a first end coupled to the base;

a housing coupled to a second end of the first arm such that the housing is disposed outwardly of the base;

a light source disposed within the housing such that light from the light source will tend to be directed towards a primary area of coverage;

an animate object detector disposed within the housing, such that the animate object detector will move in tandem with the light source as the housing is moved and such that the animate object detector will be aimed towards and will tend to be sensitive to animate objects that move within the primary area of coverage.

2. The light fixture of claim 1 wherein the first end couples to the base in a manner that permits an end user to adjust a position of the housing with respect to the base in a first dimension of adjustability.

3. The light fixture of claim 1 wherein the first end comprises an engagement surface that is biased towards a corresponding engagement surface as comprises a part of the base, and wherein the engagement surface can be readily moved by an end user's hands using ordinary strength with respect to the corresponding engagement surface to thereby permit the end user to adjust the position of the housing with respect to the base without requiring any tools.

4. The light fixture of claim 3 wherein the engagement surface is substantially identical to the corresponding engagement surface.

5. The light fixture of claim 4 wherein the engagement surface comprises a series of triangularly-shaped teeth.

6. The light fixture of claim 5 further comprising:

a stop that is configured and arranged to prevent the engagement surface from turning beyond a predetermined point with respect to the corresponding engagement surface.

7. The light fixture of claim 1 wherein the second end couples to the housing in a manner that permits an end user to adjust a position of the housing in a first dimension of adjustability.

8. The light fixture of claim 1 wherein:

the first end couples to the base in a manner that permits an end user to adjust a position of the housing in a first dimension of adjustability;

the second end couples to the housing in a manner that permits an end user to adjust a position of the housing in a second dimension of adjustability, which second dimension of adjustability is different than the first dimension of adjustability.

9. The light fixture of claim 8 wherein the second dimension of adjustability is substantially perpendicular to the first dimension of adjustability.

10. The light fixture of claim 1 wherein the housing further comprises a thermal barrier that is disposed between the light source and the animate object detector to thereby substantially prevent the light source from interfering with operability of the animate object detector.

11. The light fixture of claim 1 wherein the housing further comprises an externally exposed heat sink that is configured and arranged to sink heat sourced by the light source.

12. The light fixture of claim 11 wherein the heat sink comprises a plurality of heat radiating fins.

13. The light fixture of claim 12 wherein at least some of the heat radiating fins are disposed on a rear surface of the housing.

14. The light fixture of claim 13 wherein the heat radiating fins that are disposed on the rear surface of the housing have, in combination with one another, a peripheral envelope that is contoured to prevent the heat radiating fins from obstructing movement of the housing with respect to the base.

15. The light fixture of claim 1 further comprising:

a second arm having a first end coupled to the base;

a second housing coupled to a second end of the second arm such that the second housing is disposed outwardly of the base;

a second light source disposed within the second housing such that light from the second light source will tend to be directed towards a second primary area of coverage.

16. The light fixture of claim 15 further comprising:

a second animate object detector disposed within the second housing, such that the second animate object detector will be aimed towards and will tend to be sensitive to animate objects that move within the second primary area of coverage.

17. The light fixture of claim 15 wherein the first end of the second arm couples to the base on a side of the base that is substantially opposite to where the first end of the first arm couples to the base.

18. The light fixture of claim 17 wherein the first arm and the second arm are substantially parallel to one another.

19. The light fixture of claim 18 wherein the first arm and the second arm are substantially coaxial with respect to one another.

20. The light fixture of claim 1 wherein the light source comprises at least one light emitting diode.

* * * * *